US007825374B2

(12) United States Patent
Cotter et al.

(10) Patent No.: US 7,825,374 B2
(45) Date of Patent: Nov. 2, 2010

(54) TANDEM TIME-OF-FLIGHT MASS SPECTROMETER

(75) Inventors: Robert James Cotter, Baltimore, MD (US); Benjamin D. Gardner, Colton, CA (US); Robert D. English, Galveston, TX (US); Serguei A. Ilchenko, Solon, OH (US)

(73) Assignee: The Johns Hopkins University, Baltimore, MD (US)

( * ) Notice: Subject to any disclaimer, the term of this patent is extended or adjusted under 35 U.S.C. 154(b) by 0 days.

(21) Appl. No.: 10/546,323

(22) PCT Filed: Feb. 23, 2004

(86) PCT No.: PCT/US2004/005278

§ 371 (c)(1),
(2), (4) Date: Oct. 12, 2006

(87) PCT Pub. No.: WO2004/077488

PCT Pub. Date: Sep. 10, 2004

(65) Prior Publication Data

US 2007/0034794 A1 Feb. 15, 2007

Related U.S. Application Data

(60) Provisional application No. 60/449,168, filed on Feb. 21, 2003.

(51) Int. Cl.
*H01J 49/00* (2006.01)

(52) U.S. Cl. ..... 250/287; 250/281; 250/396 R

(58) Field of Classification Search ..... 250/287
See application file for complete search history.

(56) References Cited

U.S. PATENT DOCUMENTS 3,576,992 A * 5/1971 Moorman et al. ..... 250/287

(Continued)

FOREIGN PATENT DOCUMENTS

GB 2 371 143 7/2002
WO 95/33279 12/1995

OTHER PUBLICATIONS

International Search Report issued in PCT/US2004/005278, dated Jul. 29, 2005, 4 pages.
Written Opinion of the International Search Authority in PCT/US2004/005278, dated Jul. 29, 2005, 5 pages.

(Continued)

*Primary Examiner*—David A. Vanore
*Assistant Examiner*—Phillip A. Johnston
(74) *Attorney, Agent, or Firm*—Pillsbury Winthrop Shaw Pittman, LLP

(57) ABSTRACT

A tandem mass spectrometer includes a linear time-of-flight mass analyzer and curved field reflectron mass analyzer. The curved-field reflectron mass analyzer is disposed at an end of the linear time-of-flight mass analyzer such that ions having a plurality of ion masses formed in the linear time-of-flight analyzer such that ions having a plurality of ion masses formed in the linear time-of-flight analyzer enter the curved-field reflectron mass analyzer. The tandem mass spectrometer also includes a mass selection gate disposed between the time-of-flight mass analyzer and the curved-field reflectron mass analyzer. The mass selection gate selects an ion mass from the plurality of ion masses. Furthermore, the tandem mass spectrometer also includes a dissociating component located in a path of the ions formed in the linear time-of-flight analyzer. The dissociating component causes dissociation of the ions into a plurality of ion fragments.

30 Claims, 4 Drawing Sheets

U.S. PATENT DOCUMENTS

| | | | | |
|---|---|---|---|---|
| 5,202,563 | A * | 4/1993 | Cotter et al. | 250/287 |
| 5,464,985 | A * | 11/1995 | Cornish et al. | 250/396 R |
| 6,040,575 | A * | 3/2000 | Whitehouse et al. | 250/288 |
| 6,781,121 | B1 * | 8/2004 | Davis et al. | 250/287 |
| 2002/0125420 | A1 * | 9/2002 | Park | 250/281 |

OTHER PUBLICATIONS

Haberland et al., "Converting a reflectron time-of-flight mass spectrometer into a tandem instrument,", Rev. Soc. Instrum., vol. 62, No. 10, Oct. 1991, pp. 2368-2371.

* cited by examiner

TANDEM TIME-OF-FLIGHT MASS SPECTROMETER

This is the U.S. National Stage of International Application No. PCT/US2004/005278, filed on Feb. 23, 2004, which relies for priority upon U.S. Provisional Application No. 60/449,168 filed Feb. 21, 2003, the entire contents of both of which are hereby incorporated by reference in their entireties.

STATEMENT AS TO RIGHTS TO INVENTIONS MADE UNDER FEDERALLY SPONSORED RESEARCH AND DEVELOPMENT

The present invention resulted from research funded in whole or in part by the National Institutes of Health grant No. RR-64402. The Federal Government has certain rights in this invention.

BACKGROUND OF THE INVENTION

1. Field of Invention

The present invention relates to a mass spectrometer in general and in particular to a tandem mass spectrometer that combines two time-of-flight mass spectrometers.

2. Description of Related Art

Mass spectrometers are instruments that are used to determine the chemical composition of substances and the structures of molecules. In general they consist of an ion source where neutral molecules are ionized, a mass analyzer where ions are separated according to their mass/charge ratio, and a detector. Mass analyzers come in a variety of types, including magnetic field (B) instruments, combined electrical and magnetic field or double-focusing instruments (EB or BE), quadrupole electric field (Q) instruments, and time-of-flight (TOF) instruments. In addition, two or more analyzers may be combined in a single instrument to produce tandem (MS/MS) mass spectrometers. These include triple analyzers (EBE), four sector mass spectrometers (EBEB or BEEB), triple quadrupoles (QqQ) and hybrids (such as the EBqQ).

In tandem mass spectrometers, the first mass analyzer is generally used to select a precursor ion from among the ions normally observed in a mass spectrum. Fragmentation is then induced in a region located between the mass analyzers, and the second mass analyzer is used to provide a mass spectrum of the product ions. Tandem mass spectrometers may be utilized for ion structure studies by establishing the relationship between a series of molecular and fragment precursor ions and their products. Alternatively, they are now commonly used to determine the structures of biological molecules in complex mixtures that are not completely fractionated by chromatographic methods. These may include mixtures of, for example, peptides, glycopeptides or glycolipids. In the case of peptides, fragmentation produces information on the amino acid sequence.

One type of mass spectrometers is time-of-flight (TOF) mass spectrometers. The simplest version of a time-of-flight mass spectrometer, illustrated in FIG. 1 (Cotter, Robert J., Time-of-Flight Mass Spectrometry: Instrumentation and Applications in Biological Research, American Chemical Society, Washington, D.C., 1997), the entire contents of which is hereby incorporated by reference, consists of a short source region 10, a longer field-free drift region 12 and a detector 14. Ions are formed and accelerated to their final kinetic energies in the short source region 10 by an electric field defined by voltages on a backing plate 16 and drawout grid 18. Other grids or lenses 17 may be added to the source region to enhance extraction and to improve the mass resolution. The longer field-free drift region 12 is bounded by drawout grid 18 and an exit grid 20.

In the most common configuration, the drawout grid 18 and exit grid 20 (and therefore the entire drift length) are at ground potential, the voltage on the backing plate 16 is V, and the ions are accelerated in the source region to an energy: $mv^2/2=z\,eV$, where m is the mass of the ion, v is its velocity, e is the charge on an electron, and z is the charge number of the ion. The ions then pass through the drift region 12 and their (approximate) flight time(s) is given by the formula:

$$t=[(m/z)/2\ \mathrm{eV}]^{1/2}D \qquad \text{(I)}$$

which shows a square root dependence upon mass. Typically, the length 1 of source region 10 is of the order of 0.5 cm, while drift length (D) ranges from 15 cm to 8 meters. Accelerating voltages (V) can range from a few hundred volts to 30 kV, and flight times are of the order of 5 to 100 microseconds. Generally, the accelerating voltage is selected to be relatively high in order to minimize the effects on mass resolution arising from initial kinetic energies and to enable the detection of large ions. For example, the accelerating voltage of 20 KV (as illustrated for example in FIG. 1) has been found to be sufficient for detection of masses in excess of 300 kDaltons (kDa).

Mass resolution can be improved by pulsing one or more of the source elements such as the backing plate 16 or the grid 17. Other time-dependent pulses or waveforms may also be applied to the source (Kovtoun, S. V., English, R. D. and Cotter, R. J., Mass Correlated Acceleration in a Reflectron MALDI TOF Mass Spectrometer: An Approach for enhanced Resolution over a Broad Range, J. Amer. Soc. Mass Spectrom. 13 (2002) 135-143).

Mass resolution may also be improved by the addition of a reflectron (Mamyrin, B. A., Karataev, V. I., Shmikk, D. V. Zagulin, V. A. Sov. Phys. JETP 37 (1973) 45). A conventional reflectron is essentially a retarding electrical field which decelerates the ions to zero velocity, and allows them to turn around and return along the same or nearly the same path. Ions with higher kinetic energy (velocity) penetrate the reflectron more deeply than those with lower kinetic energy, and thus have a longer path to the detector. Ions retain their initial kinetic energy distributions as they reach the detector; however, ions of different masses will arrive at different times.

An example of a time-of-flight mass spectrometer utilizing a reflectron is shown schematically in FIG. 2 (same numerals in FIG. 1 and FIG. 2 are used to indicate same elements however positioned differently). The reflectron may be single stage 30 or dual-stage. In both single-stage and dual-stage reflectrons, a stack of electrodes 32 (also called ion lenses), each connected resistively to one another, provide constant retarding field regions that are separated by one grid 34 in the single stage reflectron 30. In the most common case, grids and lenses are constructed using ring electrodes. In the case of grid 34 illustrated in FIG. 2, the ring electrode is covered with a thin wire mesh.

In single-stage reflectrons, a single retarding region is used and approximate ion flight times are given by the formula:

$$t=[(m/z)/2\ \mathrm{eV}]^{1/2}[L_1+L_2+4d] \qquad \text{(II)}$$

which has the same square-root dependence expressed in Equation (I). The terms, in addition to those expressed in Equation (I), are L1, L2 and d. L1 and L2 are the lengths of the linear drift regions illustrated in FIG. 2, respectively, in the forward and return directions, and d is the average penetration depth. The focusing action can be understood by replacing the denominator in equation (II) with 2 eV+$U_0$, where $U_0$ represents the contribution to the ion velocity from the initial kinetic energy distribution.

While reflectrons were originally intended to improve mass resolution for ions formed in an ion source region, they have more recently been exploited for recording the mass spectra of product ions formed outside the source by metastable decay or by fragmentation induced by collisions with a target gas or surface, by photodissociation or by electron impact. Ions resulting from the fragmentation of molecular ions in the flight path can be observed at times given by the following formula:

$$t=[(m/z)/2\ \text{eV}]^{1/2}[L_1+L_2+4(m'/m)d] \quad \text{(III)}$$

where m' is the mass of the new fragment ion. In the case of peptides, these ions can provide amino acid sequences. The focusing action can be understood by replacing the denominator in equation (III) with 2 eV+$U_0$, where $U_0$ represents the contribution to the ion velocity from the initial kinetic energy distribution. These ions are generally focused by stepping or scanning the reflectron voltage VR or by using non-linear reflectrons, such as the curved-field reflectron described by Cornish and Cotter (Cornish, T. J., Cotter, R. J., Non-linear Field Reflectron, U.S. Pat. No. 5,464,985, the entire content of which is hereby incorporated by reference).

Product ions will appear in normal mass spectra as generally weak and poorly-focused peaks which cannot be easily associated with a given precursor ion. However, it is possible to record the product ion mass spectrum for a single precursor, by selecting ions of a single mass for passage through the first drift region. An example of this approach is described by Schlag et al. (Weinkauf, R.; Walter, K.; Weickhardt, C.; Boesl, U.; Schlag, E. W.: Int. J. Mass Spectrom. Ion Processes Vol. 44A (1989) pp. 1219-25), in which an electrostatic gate is located in the first drift region. The ions passed by the gate are then fragmented by photodissociation using a pulsed UV laser, and the product ions are detected after reflection.

An alternative approach was introduced by LeBeyec and coworkers using a coaxial dual-stage reflectron, and has been developed by Standing et al. (Standing, K. G.; Beavis, R.; Bollbach, G.; Ens. W.; LaFortune, F.; Main, D.; Schueler, B.; Tang, X; Westmore, J. B. Analytical Instrumentation 16(1) (1987) pp. 173-89) using a single-stage reflectron. In this approach, all ions are permitted to enter the reflectron. A detector is also located at the rear of the reflectron and records neutral species resulting from the metastable decay in the first field-free drift length. Because these neutrals appear at time corresponding to the mass of the precursor ion, it is then possible to only register ions in the reflectron detector when a neutral corresponding to the precursor mass is received. The resultant spectrum, known as a correlated reflex spectrum, can only be obtained with methods that employ single ion pulse counting.

A major limitation of the reflectrons designed to date is that focusing of product ions (mass resolution) is not constant over the mass range. Specifically, the selected precursor ion mass is generally the most well focused ion in the product ion mass spectrum, while focusing decreases for product ions with lower mass. This is generally attributed to the fact that lower mass product ions do not penetrate the reflectron to as great a depth as ions whose masses are close to the precursor ion mass. Thus, it has been a common observation that lowering the reflection voltages permits recording of the low mass portion of the spectrum with considerably better focus, while the higher mass ions simply pass through the back end of the reflectron.

For this reason, several investigators have suggested stepping the reflectron voltages to record different regions of the mass spectrum, or scanning the reflectron voltages and reconstructing a focused mass spectrum from a series of transients (Weinkauf, R.; Walter, K.; Weickhardt, C.; Boesl, U.; Schlag, E. W. Int. J. Mass Spectrom. Ion Processes Vol. 44a (1989) pp. 1219-25 and Spengler, B.; Kirsch, D.; Kaufmann, R.; Jaeger, E. Rapid Commun. Mass Spectrom. 6 (1992) pp. 105-08). For product ion mass spectra, this approach has the same disadvantages as the time-slice method employed by Wiley and McLaren, in that it does not realize the full multiplex recording advantage of the time-of-flight mass spectrometer.

Although product ion mass spectra can be recorded in single TOF analyzers employing a reflectron, a number of investigators have described a variety of tandem configurations in which the first mass analyzer is utilized to select the precursor ion mass, while the second mass analyzer is used to record its product ion mass spectrum. Approaches using two linear TOF mass analyzers (i.e., without reflectrons) and reacceleration of the product ions have been described by Derrick (Jardine, D. R.; Morgan, J.; Alderdice, D. S.; Derrick, P. J.: Org. Mass Spectrom. Vol. 27 (1992) pp. 1077-83) and Cooks (Schey, K. L.; Cooks, R. G.; Grix, R; Wollnik, H., International Journal of Mass Spectrometry and Ion Processes Vol. 77 (1987) pp. 49-61).

A linear/reflectron (TOF/RTOF) configuration has also been reported by Cooks (Schey, K. L.; Cooks, R. G.; Kraft, A.; Grix, R.; Wollnik, H., International Journal of Mass Spectrometry and Ion Processes Vol. 94 (1989) pp. 1-14). Strobel and Russell (Strobel, F. H.; Solouki, T.; White, M. A.; Russell, D. H., J. Am. Soc. Mass Spectrom. Vol. 2 (1990) pp. 91-94); and (Strobel, F. H.; Preston, L. M.; Washburn, K. S.; Russell, D. H., Anal. Chem. Vol. 64 (1992) pp. 754-62) have recently described a hybrid instrument (EB/RTOF) using a double-focusing sector mass analyzer for mass selection and a reflectron TOF to record the product ions.

In addition, Cotter and Cornish (Cornish, T. J.; Cotter, R. J. Analytical Chemistry Vol. 65 (1993) pp. 1043-47, the entire content of which is hereby incorporated by reference) and (Cornish, T. J.; Cotter, R. J. Org. Mass Spectrom., the entire content of which is hereby incorporated by reference) have described a tandem (RTOF/RTOF) time-of-flight instrument using two reflecting time-of-flight mass analyzers. The first analyzer permits high resolution selection of the precursor ion by electronic gating prior to a collision cell, while the second mass analyzer is used to record the collision induced dissociation (CID) or product ion mass spectrum. In this instrument, both dual-stage and single-stage reflectrons have been used. However, both single and dual stage reflectrons currently suffer from the focusing limitations described above.

The tandem time-of-flight mass spectrometer has several clear advantages over the reflectron TOF analyzer for recording of product ion mass spectra. In many instances, these advantages resemble the advantages of a four sector (EBEB) instrument over the linked E/B scanning methods employed on two sector (EB) mass spectrometers.

That is, the tandem time-of-flight permits higher mass resolution selection of the precursor ion because electronic gating is accomplished as the ions are brought into time focus at the collision chamber. In contrast, ion mass gating in the first linear region (L1) of a reflectron TOF is carried out prior to focusing by the reflectron. Secondly, a tandem time-of-flight mass spectrometer incorporating two reflectrons can more clearly separate metastable processes from collision induced dissociation, since metastable ions that occur in the first field free region and traverse the first reflectron do not arrive at the ion mass gate at the same time.

In 1993 Enke and coworkers (Seterlin, M. A.; Vlasak, P. R.; McLane, R. D.; Enke, C. G., J. Am. Chem. Soc. 4 (1993) 751-754), also designed a tandem time-of-flight mass spectrometer, but used photodissociation to form the product ions. The focusing problem was adressed by decelerating the ions just prior to dissociation and reaccelerating the product ions into the second reflectron analyzer. However, this approach does not take full advantage of the full initial kinetic energy when collision induced dissociation is used. In a tandem instrument described by Vestal and co-workers (Medzihradsky, K. F.; Campbell, J. M.; Baldwin, M. A.; Falik, A. M.; Juhasz, P.; Vestal, M. L.; Burlingham, A. L., Anal. Chem. 72 (2000) 552-558) and commercialized by applied biosystems of Framingham, Mass., ions are formed by Matrix Assisted Laser Desorption Ionization (MALDI) and focused by pulsed or delayed extraction to a focal point where the ions are mass selected by a timed ion gate. The ions then pass through a collision cell where they are dissociated. The product ions continue to have the same velocities as their mass selected precursors, so that they all enter a second "source" at the same time. They are then accelerated into a reflectron mass analyzer by pulsed extraction. In order to accommodate the limited bandwidth of the reflectron, the kinetic energy of the precursor ions (and hence the collision energy in the laboratory frame) is kept 1 to 2 keV, with pulsed extraction in the second source providing an additional 18 keV to the product ions. In this way, ions enter the reflectron with a range of energies for 18 to 20 keV. In an instrument designed at BRUKER DALTONICS from Bellerica, Mass., initial kinetic energies (and laboratory collision energies) are also set at few keV, with the additional acceleration of the product ions provided by raising the potential of a lift cell while the ions are in residence (Schnaible, V.; Wefing, S.; Resemann, A.; Suckau, D.; Bucker, A.; Wolf-Kummeth, Hoffman, D., Anal. Chem. 74 (2002) 4980-4988).

SUMMARY OF THE INVENTION

An aspect of the present invention is to provide a tandem mass spectrometer that includes a linear time-of-flight mass analyzer and a curved-field reflectron mass analyzer. The curved-field reflectron mass analyzer is disposed at an end of the linear time-of-flight mass analyzer such that ions having a plurality of ion masses formed in the linear time-of-flight analyzer enter the curved-field reflection mass analyzer. The tandem mass spectrometer also includes a mass selection gate disposed between the time-of-flight mass analyzer and the curved-field reflectron mass analyzer. The mass selection gate selects an ion mass from the plurality of ion masses. Furthermore, the tandem mass spectrometer also includes a dissociating component located in a path of the ions formed in the linear time-of-flight analyzer. The dissociating component causes dissociation of the ions into a plurality of ion fragments.

In one embodiment, the linear time-of-flight analyzer includes an ion source. The ion source may, for example, include a sample plate and a source of ionizing energy. The ion source may also be provided with an extraction electrode disposed proximate the sample plate. The source of ionizing energy can be, for example, a laser, an electron beam source, an energetic ion beam, a source of an energetic atomic beam or a radio-frequency voltage source. The sample plate can be held at a sample voltage with a magnitude between about 1 kilovolt to 50 kilovolts. The sample voltage can be pulsed to focus ions formed in the ion source. Similarly, the extraction electrode can be held at an extraction voltage with a magnitude between about 1 kilovolt to 50 kilovolts.

In one embodiment, the curved-field reflectron analyzer includes a plurality of hollow electrodes connected to selected electrical voltage potentials such that the plurality of hollow electrodes together generate a non-linear retarding electrical field which decelerate the ion fragments to zero velocity and allow the ion fragments to turn around. The non-linear retarding field in the curved-field reflectron is defined by the electrical voltage potentials whose dependence on depth of penetration of the ion fragments follow, for example, an arc of circle. The non-linear retarding field in the curved-field reflectron may be configured to focus at least a major portion of the ion fragments formed at any point along a flight portion of the tandem mass spectrometer. The non-linear retarding field in the curved-field reflectron can also be configured to focus at least a major portion of a mass range of the ion fragments without having to scan or step the electrical voltage potentials in the curved-field reflectron to accommodate an energy bandwidth of curved-field reflectron. The non-linear retarding field in the curved-field reflectron can be configured to focus the ion fragments over at least a major portion of a mass range of the ion fragments without providing additional kinetic energy to the ion fragments to accommodate an energy bandwidth of the curved-field reflectron.

The tandem mass spectrometer may also be provided with an ion detector arranged in an ion fragment path. The ion detector may include a channeltron, an electron multiplier or a microchannel plate assembly arranged to intercept particles to be measured.

The dissociating component may include a collision chamber or collision cell. The collision chamber can be disposed before the mass selection gate in the path of the ions or after the mass selection gate in the path of the ions. The collision chamber can be filled with a gas, for example, an inert gas. The dissociating component is not limited to a collision chamber but can also include an electron beam, an energetic atomic source or a photon beam configured to dissociate the ions.

In one embodiment, the mass selection gate is a Bradbury-Nielsen ion gate adapted to select a desired ion mass in the plurality of ion masses.

BRIEF DESCRIPTION OF THE DRAWINGS

These and other aspects and features of the invention will become more apparent and more readily appreciated from the following detailed description of the presently preferred exemplary embodiments of the invention, taken in conjunction with the accompanying drawings, of which.

DETAILED DESCRIPTION OF EXEMPLARY EMBODIMENTS OF THE INVENTION

In the present invention, a high performance time of flight mass spectrometer allows for collision induced dissociation (CID) of ions and tandem mass analysis by using a linear time-of-flight spectrometer coupled with a curved-field reflectron (reflectron analyzer). The curved-field reflectron provides a high kinetic energy focusing bandwidth which permits the use of relatively high collisions energies (in the laboratory frame). In this way, the need for reaccelerating or "lifting" the energies of ion fragments, products of the dissociation, prior to entering the reflectron analyzer is obviated.

Figure 1:
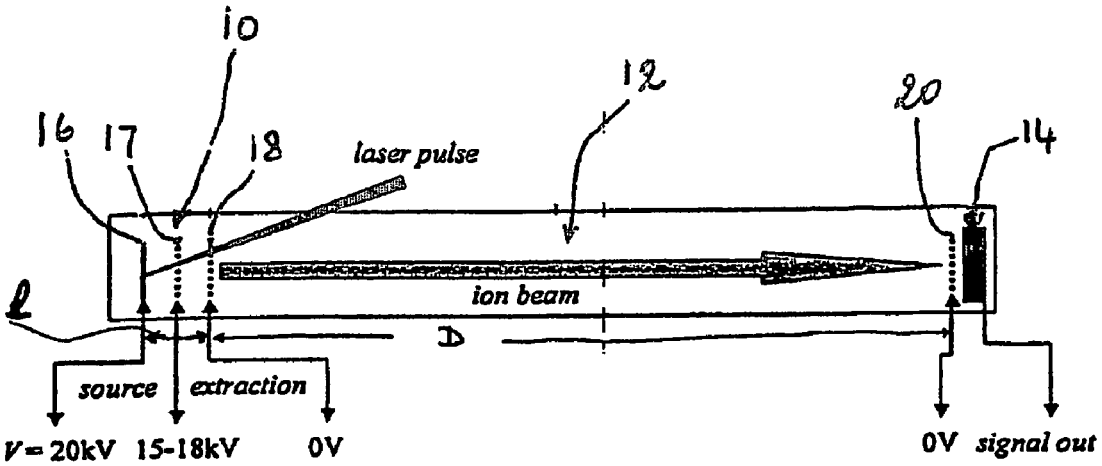
FIG. 1 PRIOR ART
FIG. 1 is a schematic representation of a conventional time-of-flight spectrometer.
Figure 2:
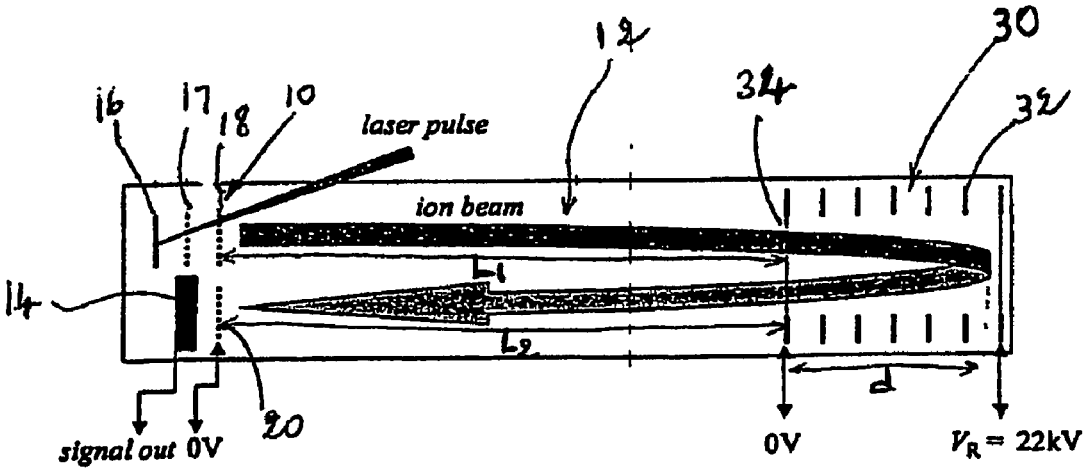
FIG. 2 PRIOR ART
FIG. 2 is a schematic representation of a conventional time-of-flight spectrometer using a reflectron.
Figure 3:
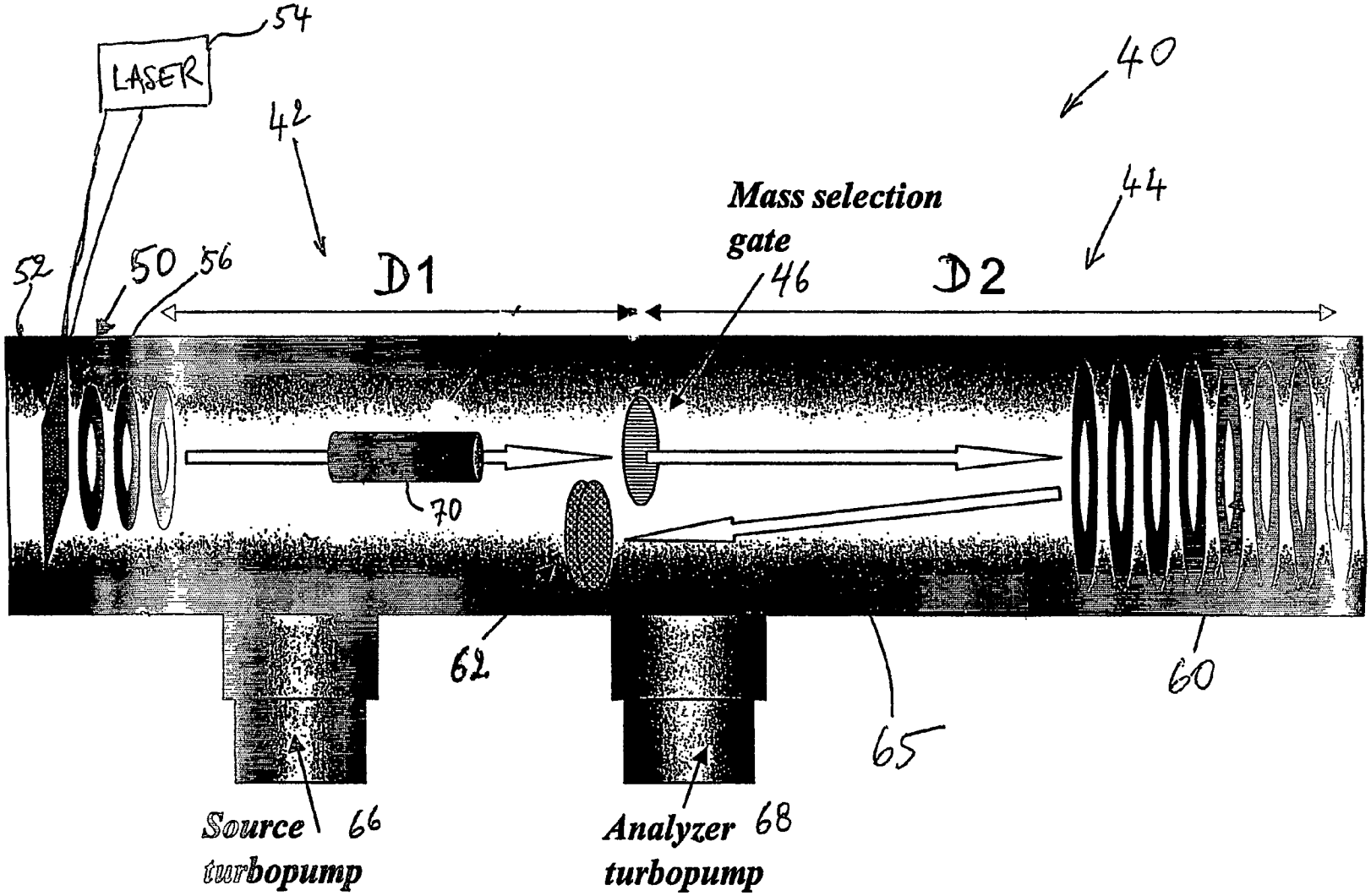
FIG. 3 is a schematic representation of one embodiment of a tandem mass spectrometer according to the present invention.

One embodiment of a mass spectrometer according to the present invention is shown in FIG. 3. Mass spectrometer 40 includes a linear time-of-flight mass analyzer 42 and a curved-field reflectron mass analyzer 44. The curved-field mass analyzer 44 is disposed at an end of the linear time-of-flight mass analyzer 42. The mass spectrometer 40 also includes a mass selection gate 46 disposed between the linear time-of-flight mass analyzer 42 and the curved field reflectron mass analyzer 44.

The time-of-flight mass analyzer includes ion source 50. The ion source 50 has a sample plate 52 and an ionizing source 54. The sample plate 52 holds a sample of material (not shown) being mass analyzed. The sample plate 52 can be a simple sample probe, a more complex sample array with a movable stage, or other mechanisms allowing placement of the sample relative to the ionizing source 54. The sample material can be, for example, a chemical agent or a biomolecule such as DNA. The sample plate 52 is biased at relatively high voltage, for example, 20 kV.

The ionizing source 54 can be any radiation source, such as a laser radiation source, as illustrated for example in FIG. 3, an electron beam, an ion source, or a fast (energetic) atom source. A laser radiation source is well suited for Matrix Assisted Laser Desorption Ionization (MALDI). In an electron beam source, the ions are generated via electron impact with the sample material. Similarly, the ions to be analyzed can also be generated by impinging an ion beam on the sample of material. The ionizing source 54 can also be a plasmatron, i.e. a plasma discharge ion source which can, for example, use radio-frequency to induce ionization and formation of ions in the sample material (this technique is well suited for mass analysis of chemical agents having a relatively small molecular size).

The ion source 50 further include extraction electrode(s) 56 disposed proximate the sample plate 52. The extraction electrode 56 may include a grid electrode held at a potential relative to the sample plate 52 such that ions formed in the sample plate 52 region are extracted. The extraction electrode 56 may also include other ion extraction optics which can be annular in shape, as illustrated in FIG. 3, to allow the ions formed to travel through central openings of the annular ion optics.

The voltage of sample plate 52 or the voltage of the extraction electrode(s) can be pulsed. Pulsing the voltage of sample source 52 or the voltage extraction electrode allows one to achieve better focusing of the ions. Various pulsing schemes exist, including using several variations of voltage waveforms (e.g., linear, exponential) as well as adjusting the delay time of the voltage pulse relative to the laser pulse (in MALDI). Exemplary pulsing ion extraction methods have been described in a commonly assigned U.S. Pat. No. 6,518,568, the entire contents of which are incorporated herein by reference.

The curved-field reflectron 44 can, for example, have a single continuous, but non-linear region. The curved field reflectron has a stack of electrodes 60 (also called ion lenses). Each of the electrodes is connected resistively to one another to define a non-linear retarding field. In the most common case, the stack of electrodes 60 are constructed using ring electrodes. The stack of electrodes 60 are connected to selected electrical voltage potentials such that the stack of electrodes 60 together generate a retarding electrical field which decelerate the ions to zero velocity and allow the ions to turn around and return along nearly the same path. In the return path, the ions are directed toward ion detector 62. Ions with higher kinetic energy (velocity) penetrate the curved-field reflectron, i.e. the stack of electrodes 60, more deeply than ions with lower kinetic energy, and thus have a longer path to the detector 62. Ions retain their initial kinetic energy distributions as they reach the detector 62. However, ions of different masses will arrive at different times.

The detector 62 can be selected from any commercially available charged particle detector. Such detectors include, but are not limited to, an electron multiplier, a channeltron or a micro-channel plate (MCP) assembly. An electron multiplier is a discrete dynode with a series of curved plates facing each other but shifted from each other such that an ion striking one plate creates secondary electrons and then an avalanche of electrons through the series of plates. A channeltron is a horn-like shaped continuous dynode structure that is coated on the inside with an electron emissive material. An ion striking the channeltron creates secondary electrons resulting in an avalanche effect to create more secondary electrons and finally a current pulse. A microchannel plate is made of a leaded-glass disc that contains thousands or millions of tiny pores etched into it. The inner surface of each pore is coated to facilitate releasing multiple secondary electrons when struck by an energetic electron or ion. When an energetic particle such as an ion strikes the material near the entrance to a pore and releases an electron, the electron accelerates deeper into the pore striking the wall thereby releasing many secondary electrons and thus creating an avalanche of electrons.

The detected electron signal corresponding to an ion striking the detector is further amplified, integrated, digitized and recorded into a memory for later analysis and/or displayed through a graphical interface for evaluation. An example for a detection method is disclosed in a commonly assigned U.S. Pat. No. 5,572,025, the entire contents of which are incorporated herein by reference.

The linear time-of-flight mass analyzer 42 and the curved-field mass analyzer 44 are disposed end-to-end such that ions generated in mass analyzer 42 enter mass analyzer 44 for further mass analysis as will be explained in more detail in the following paragraphs. The electrodes in mass analyzer 42, such as the extraction electrodes 56, and electrodes in mass analyzer 44, such as retarding electrodes 60, and detector 62 are enclosed in vacuum chamber 65 to allow collisionless movement of ions formed in ion source 50 during operation of the tandem mass spectrometer 40. The vacuum chamber 65 is pumped by using one or more vacuum pumps and is kept at a pressure below $5\times10^{-7}$ Torr. For example, two turbo-molecular pumps can be used. Turbomolecular pump 66 is used to pump the mass analyzer 42 region and turbomolecular pump 68 is used to pump mass analyzer 44 region.

The mass analyzer 40 operates to select an ion mass (precursor ion mass) among the plurality of ion masses formed in the ion source 50. The precursor ion mass is then dissociated by collision with a gas (collisional dissociation) leading to the formation of a plurality of product ions. However, it can be appreciated that the dissociation of the precursor ion mass is not limited to only a dissociation via a collision with a gas but the dissociation of the precursor ion mass can also be accomplished by photodissociation by using a photon beam (laser) or electron impact dissociation by using a source of electrons. The reflection mass analyzer 44 is used to record the product ion mass spectrum of the product ions resulting from the dissociation of the precursor ion mass.

For example, as shown in FIG. 3, in the case of a collisional dissociation, a collision chamber 70 (i.e., a dissociating component) is disposed in the path of the selected ion mass. The collision chamber 70 is filled with an inert gas such as helium, argon or xenon. The collision chamber can have various shapes. In one embodiment, the collision chamber 70 is a stainless steel cylinder with X cm internal diameter by Y cm length (for example, 0.2 inch (5 mm) internal diameter and 1.125 inches (2.85 cm) long). The density of gas within the collision chamber 70 is selected to provide efficient dissociation while maintaining a relatively low ambient pressure in both the mass analyzer 42 and mass analyzer 44 regions to avoid degradation in mass resolution. Therefore, pressure monitors are also provided to monitor both the pressure inside the chamber 62 and the pressure inside collision chamber 70.

A mass selection gate 46 is disposed between mass analyzer 42 and mass analyzer 44. As illustrated in FIG. 3, the mass selection gate 46 is disposed at a distance D1 from an end of ion source 50 and at a distance D2 from an end of reflectron electrodes 60. In the embodiment shown in FIG. 3, the collision chamber 70 is disposed before the mass selection gate 46 in the path of the precurssor ion. However, the collision chamber 70 can be positioned anywhere along the path of the ions. For example, the collision chamber 70 can also be positioned after the mass selection gate 46. A suitable mass selection gate 46 is a Bradbury-Nielsen ion gate (Bradbury, N. E.; Nielsen, R. A., Phys. Rev. 49 (1936) 388-393). A Bradbury-Nielsen ion gate is an ion gate constructed of parallel wires. The gate can be closed by applying a potential across adjacent wires creating an electric field perpendicular to the trajectory of ions thus effectively blocking the passage of selected ions. In this way only selected ions are allowed to continue in their path and the other ions are rejected or blocked.

The precursor ion mass dissociates upon impact with the inert gas (e.g. helium) thus creating neutral fragment species as well as ionic fragment species (product ions). The neutral species are not affected by the electric potential field of the reflectron and continue in a relatively straight line whereas the ionic fragment species decelerate to zero velocity and make a U-turn and return along nearly the same path traveling toward the detector 62.

The mass selection is made at a location within the time-of-flight drift length, which is the focus for both the pulsed ion extraction from the source 50 and for the curved-field reflectron 44. As shown in FIG. 3, the collision chamber 70 is mounted before the mass selection gate 46. The molecular ion precursor and its dissociated fragment (product) ions will exit the collision chamber 70 with nearly identical velocities and will thus enter the ion gate 46 substantially at the same time. Thus, it is possible to locate the collision chamber before the ion gate. In fact, because velocities do not change for precursor ions and their respective products from the ion source 50 to the entrance of the curved-field reflectron 60, the collision chamber 70 and ion gate 46 may be arranged in any order relative to each other. Unlike tandem instruments utilizing a single stage and dual stage reflectron, precursor and product ions are not reaccelerated after collision, but maintain the full range of kinetic energies entering the curved-field reflectron. Furthermore, in the present tandem mass spectrometer, the reflectron voltage is not stepped or scanned to accommodate the differences in energy and the full kinetic energy of ions (for example 20 keV) exiting the source may be utilized as collision energy.

The present invention can be further appreciated from the following examples of operation and their application in the analysis of chemical and biological samples.

Figure 4A:
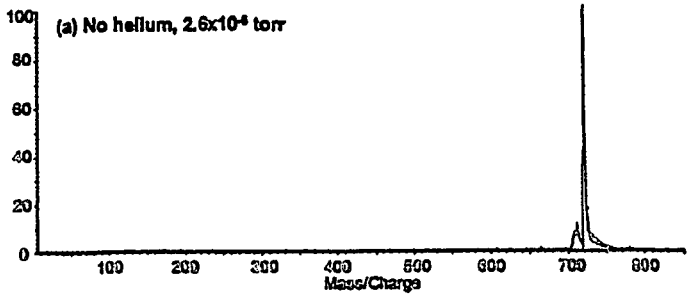
FIGS. 4A-4F show helium induced dissociation spectra obtained for Buckminsterfullerene ($C_{60}$)
Figure 4B:
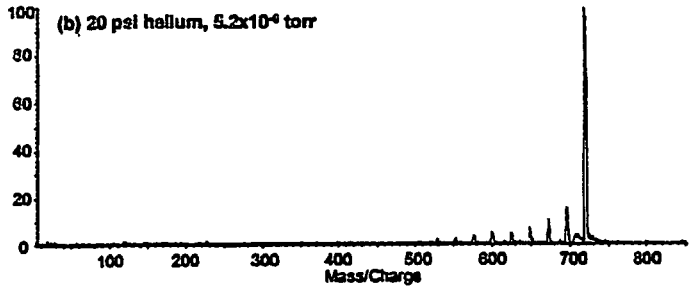
Figure 4C:
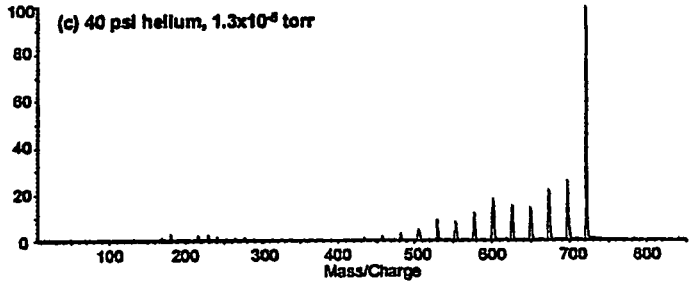
Figure 4D:
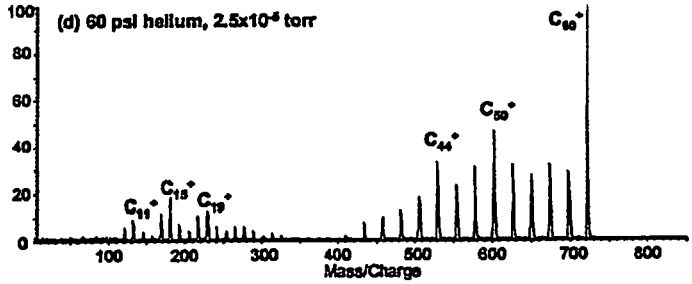
Figure 4E:
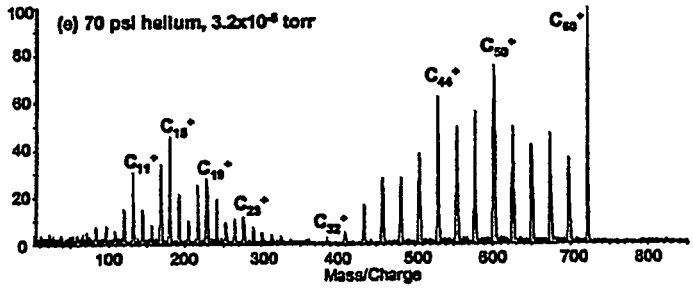
Figure 4F:
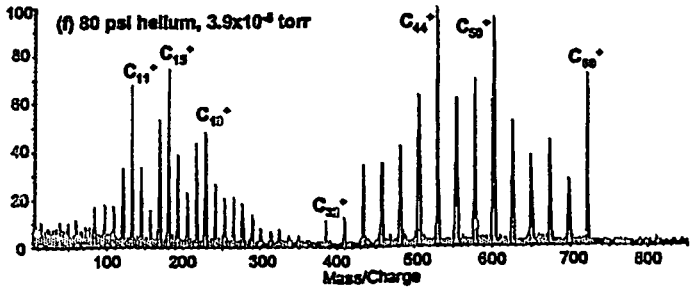

FIGS. 4A-4F show helium induced dissociation spectra obtained for Buckminsterfullerene ($C_{60}$). FIG. 4A is a mass spectrum of fullerene with no gas, i.e. no helium. FIGS. 4B-4F are mass spectra of fullerene with increasing amounts of helium added to the collision chamber or collision cell. The initial fragments that first appear in FIG. 4B are $C_{2n}^+$ series of ions, with $C_{44}^+$ and $C_{50}^+$ being the dominant clusters. It has been shown by reionization of the neutral products that this series results from losses of large $C_n$ neutrals rather than stepwise losses of $C_2$. In the study (McHale, K. J.; Polce, M. J.; Wesdemiotes, C., J. Mass Spectrom. 30 (1995) 33-38), the observation of $C_{28}$ as the largest neutral is consistent with the present observation that the smallest $C_{2n}^+$ cluster ion is the $C_{32}^+$ ion. In FIG. 4D a distribution of lower mass clusters is observed in the Collision Induced Dissociation (CID) spectrum and these clusters differ by one carbon atom. From ion intensity measurements, the inventors estimate that this spectrum corresponds to an attenuation of the molecular ion beam of about 80%. These lower mass clusters increase in intensity in the mass spectra shown in FIGS. 4E and 4F for which the attenuations are 95% and 98%, respectively. The appearance of the low mass $C_n^+$ series at high attenuation suggests that these ions result from multiple or "catastrophic" collisions that result in a distribution pattern with predominant peaks at $C_{11}^+$, $C_{15}^+$, $C_{19}^+$ and $C_{23}^+$ that is similar to that observed in the laser ablation of graphite. When 20 keV ion kinetic energies are used, the 20 keV ion kinetic energies are not appreciably altered by collisions with helium, so that resolution is maintained for the $C_n^+$ series. At 4 keV, the inventors noted that collisions with argon or xenon produced only the low mass $C_n^+$ series at any level of attenuation and these were generally well resolved, suggesting that even single collisions were catastrophic. Consistent with that observation, no meaningful fragments using 20 keV beam and argon or xenon were detected, even when the beam is attenuated. In this example and other examples below, the helium is found to be the most advantageous at high laboratory energy.

Figure 5A:
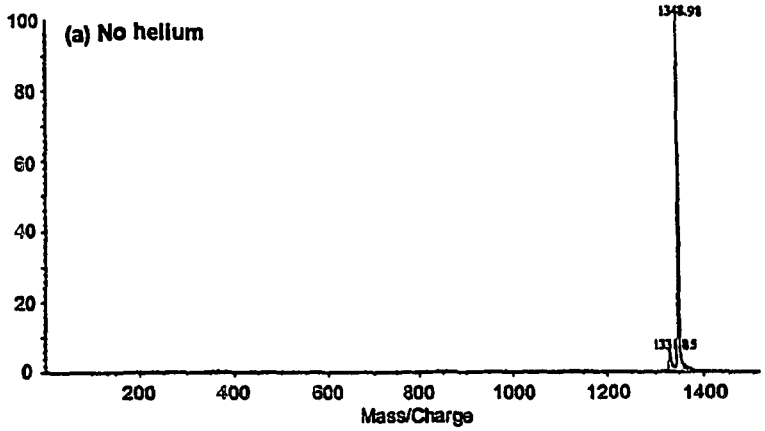
FIGS. 5A-5D represent tandem collision induced dissociation (CID) mass spectra obtained for peptides.
Figure 5B:
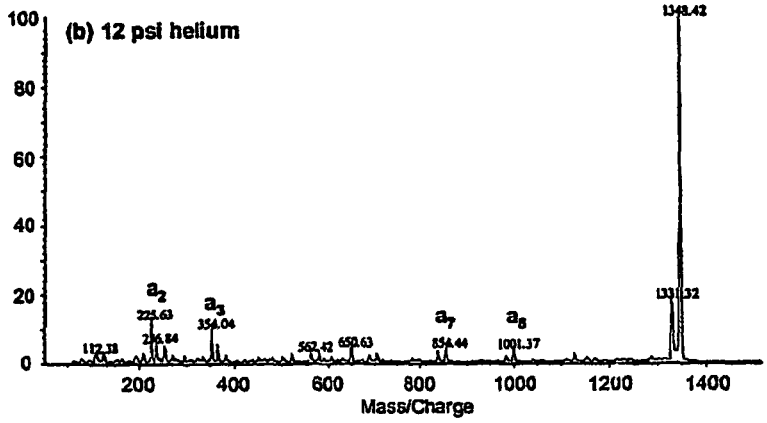
Figure 5C:
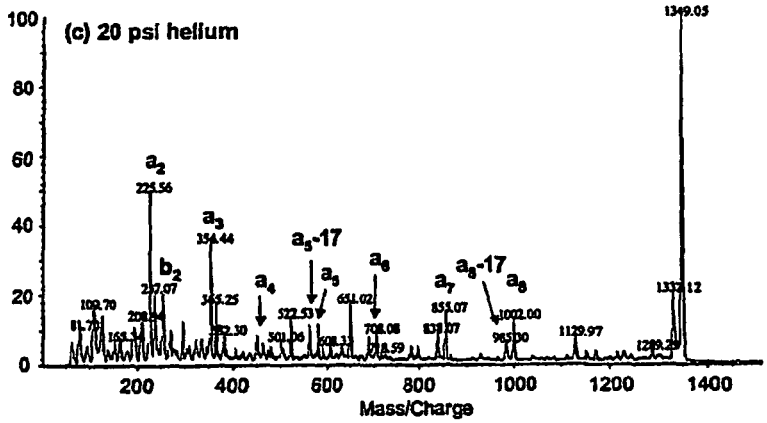
Figure 5D:
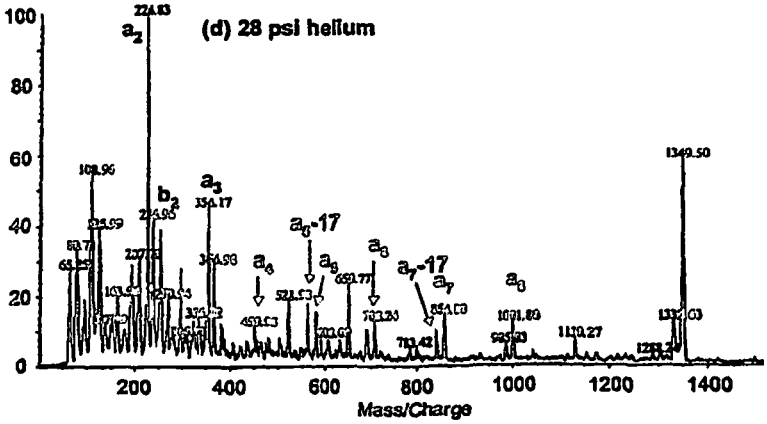

FIGS. 5A-5D represent tandem collision induced dissociation (CID) mass spectra obtained for peptides. FIG. 5A shows a gated mass spectrum of substance P. Specifically, the protonated molecular ion is mass-selected, i.e. there is no collision gas, and the laser power is sufficiently low that no fragmentation is observed from post-source decay. FIGS. 5B-5D show the effects of increases in the amount of helium added to the collision chamber. As seen in the FIGS. 5B-5D, the "a and a-17" series dominate the CID mass spectrum, with the lower mass sequence ions increasing with increasing collision gas pressure.

In these studies, the laboratory collision energy used is the maximum precursor ion kinetic energy available from acceleration from a 20 kV ion source, i.e. 20 keV, for example. This is possible because there is no need to reaccelerate the product ions to meet the energy bandwidth requirements of the reflectron.

In the center of mass frame, the collisions energy is given by:

$$E_{rel} = \frac{1}{2}\frac{m_{ion}m_{gas}}{m_{ion}+m_{gas}}v_{rel}^2,$$

where $v_{rel}$ is the relative velocity in the center of mass frame. The thermal velocities of the inert gas are negligible in comparison with the velocity of the precursor ion. Thus, the above equation becomes:

$$E_{rel} = \frac{m_{gas}}{m_{ion} + m_{gas}} E_{lab}.$$

Therefore, a relatively large ion colliding with a relatively small atom (gas) such as helium leads to a relatively small relative energy in the center of mass frame.

For example, for a $C_{60}$/He collisional system an Elab of 20 keV provides a relative collisional energy in the center of mass of 55.4 eV. For a $C_{60}$/Ar collisional system an Elab of 20 keV provides a relative collisional energy in the center of mass of 1050 eV and for a $C_{60}$/Xe collisional system an Elab of 20 keV provides a relative collisional energy in the center of mass of 3080 eV. Similarly, for Substance P/He collisional system an Elab of 20 keV provides a relative collisional energy in the center of mass of 29.6 eV. For Substance P/Ar collisional system an Elab of 20 keV provides a relative collisional energy in the center of mass of 576 eV and for Substance P/He collisional system an Elab of 20 keV provides a relative collisional energy in the center of mass of 1770 eV. The use of smaller collision energies in the center of mass frame with helium may be preferable to the use of larger inert gases. While effectively attenuating the molecular ion beam, argon and xenon reduced the overall number of ions observed. This is most likely the result of scattering.

Although the tandem mass spectrometer of the present invention is shown in various specific embodiments, one of ordinary skill in the art would appreciate that variations to these embodiments can be made therein without departing from the spirit and scope of the present invention. For example, although the mass spectrometer is shown having a certain number of electrodes (such as the source electrodes and the reflectron electrodes) one would appreciate that adding one or more electrodes to the tandem mass spectrometer is within the scope of the invention. Furthermore, although the mass spectrometer has been described with the use of a laser ionization source, one of ordinary skill in the art would appreciate that using electrospray, atmospheric pressure ionization (API) and atmospheric MALDI (APMALDI) are also within the scope of the present invention. The many features and advantages of the present invention are apparent from the detailed specification and thus, it is intended by the appended claims to cover all such features and advantages of the described apparatus which follow the true spirit and scope of the invention.

Furthermore, since numerous modifications and changes will readily occur to those of skill in the art, it is not desired to limit the invention to the exact construction and operation described herein. Moreover, the process and apparatus of the present invention, like related apparatus and processes used in the mass spectrometry arts tend to be complex in nature and are often best practiced by empirically determining the appropriate values of the operating parameters or by conducting computer simulations to arrive at a best design for a given application. Accordingly, all suitable modifications and equivalents should be considered as falling within the spirit and scope of the invention.

We claim:

1. A tandem mass spectrometer, comprising:

a linear time-of-flight mass analyzer having a field-free drift region;

a curved-field reflectron mass analyzer disposed at an end of the linear time-of-flight mass analyzer such that ions having a plurality of ion masses when formed in the linear time-of-flight analyzer enter the curved-field reflectron mass analyzer, wherein the curved-field reflectron comprises a drift region and a non-linear field region defined by a series of lens elements;

a mass selection gate disposed between the linear time-of-flight mass analyzer and the curved-field reflectron mass analyzer, the mass selection gate being located in the field-free drift region, upstream of the non-linear field region, said mass selection gate operable to select an ion mass from said plurality of ion masses; and a dissociating component located in a path of the ions formed in the linear time-of-flight analyzer, wherein said dissociating component causes dissociation of said ions into a plurality of ion fragments.

2. The tandem mass spectrometer according to claim 1, wherein the linear time-of-flight analyzer comprises an ion source.

3. The tandem mass spectrometer according to claim 2, wherein said ion source comprises a sample plate and a source of ionizing energy.

4. The tandem mass spectrometer according to claim 3, wherein said ion source further comprises an extraction electrode disposed proximate said sample plate.

5. The tandem mass spectrometer according to claim 3, wherein said source of ionizing energy is a laser.

6. The tandem mass spectrometer according to claim 3, wherein said source of ionizing energy is an electron beam source.

7. The tandem mass spectrometer according to claim 3, wherein said source of ionizing energy is an energetic ion beam.

8. The tandem mass spectrometer according to claim 3, wherein said source of ionizing energy is an energetic atomic beam.

9. The tandem mass spectrometer according to claim 3, wherein said source of ionizing energy is a radio-frequency voltage source.

10. The tandem mass spectrometer according to claim 4, wherein said extraction electrode includes a grid electrode held at a voltage relative to said sample plate such that ions formed in said sample plate are extracted from said sample plate.

11. The tandem mass spectrometer according to claim 3, wherein said sample plate is held at a sample voltage.

12. The tandem mass spectrometer according to claim 11, wherein said sample voltage is a voltage with a magnitude between about 1 kilovolt to 50 kilovolts.

13. The tandem mass spectrometer according to claim 11, wherein said sample voltage is pulsed to focus ions formed in said ion source.

14. The tandem mass spectrometer according to claim 4, wherein said extraction electrode is held at an extraction voltage, and said extraction voltage is a voltage with a magnitude between about 1 kilovolt to 50 kilovolts.

15. The tandem mass spectrometer according to claim 1, wherein the non-linear field region in the curved-field reflectron is configured to focus at least a major portion of the ion fragments formed at any point along a flight portion of the tandem mass spectrometer, the flight portion including the drift region in the linear time-of-flight mass analyzer and the drift region in the curved-field reflectron mass analyzer.

16. The tandem mass spectrometer according to claim 1, wherein the non-linear field region in the curved-field reflectron is configured to focus at least a major portion of a mass range of the ion fragments without having to scan or step the electrical voltage potentials in the curved-field reflectron to accommodate an energy bandwidth of the curved-field reflectron.

17. The tandem mass spectrometer according to claim 1, wherein the non-linear field region in the curved-field reflectron is configured to focus the ion fragments over at least a major portion of a mass range of the ion fragments without providing additional kinetic energy to the ion fragments to accommodate an energy bandwidth of the curved-field reflectron.

18. A tandem mass spectrometer comprising:

a linear time-of-flight mass analyzer having a field-free drift region;

a curved-field reflectron mass analyzer disposed at an end of the linear time-of-flight mass analyzer such that ions having a plurality of ion masses when formed in the linear time-of-flight analyzer enter the curved-field reflectron mass analyzer, wherein the curved-field reflectron comprises a drift region and a non-linear field region defined by a series of lens elements;

a mass selection gate disposed between the time-of-flight mass analyzer and the curved-field reflectron mass analyzer, the mass selection gate being located in the field-free drift region, upstream of the non-linear field region, said mass selection gate operable to select an ion mass from said plurality of ion masses;

an ion detector arranged in an ion fragment path; and a dissociating component located in a path of the ions formed in the linear time-of-flight analyzer, wherein said dissociating component causes dissociation of said ions into a plurality of ion fragments.

19. The tandem mass spectrometer according to claim 18, wherein said ion detector comprises a channeltron arranged to intercept particles to be measured.

20. The tandem mass spectrometer according to claim 18, wherein said ion detector comprises an electron multiplier arranged to intercept the ion fragments to be measured.

21. The tandem mass spectrometer according to claim 18, wherein said ion detector comprises a micro channel plate assembly arranged to intercept ions to be measured.

22. A tandem mass spectrometer, comprising:

a linear time-of-flight mass analyzer having a field-free drift region;

a curved-field reflectron mass analyzer disposed at an end of the linear time-of-flight mass analyzer such that ions having a plurality of ion masses when formed in the linear time-of-flight analyzer enter the curved-field reflectron mass analyzer, wherein the curved-field reflectron comprises a drift region and a non-linear field region defined by a series of lens elements;

a mass selection gate disposed between the time-of-flight mass analyzer and the curved-field reflectron mass analyzer, the mass selection gate being located in the field-free drift region, upstream of the non-linear field region, said mass selection gate operable to select an ion mass from said plurality of ion masses; and a dissociating component located in a path of the ions formed in the linear time-of-flight analyzer, wherein said dissociating component causes dissociation of said ions into a plurality of ion fragments, wherein the dissociating component comprises a collision chamber.

23. The tandem mass spectrometer according to claim 22, wherein the collision chamber is filled with an inert gas.

24. The tandem mass spectrometer according to claim 1, wherein the dissociating component comprises an electron beam configured to dissociate the ions.

25. The tandem mass spectrometer according to claim 1, wherein the dissociating component comprises an energetic atomic source configured to dissociate the ions.

26. The tandem mass spectrometer according to claim 1, wherein the dissociating component comprises a photon beam configured to dissociate the ions.

27. The tandem mass spectrometer according to claim 1, wherein the mass selection gate is a Bradbury-Nielsen ion gate adapted to select a desired ion mass in said plurality of ion masses.

28. The tandem mass spectrometer according to claim 1, wherein the dissociating component is disposed after the mass selection gate within the drift region of the curved-field reflectron mass analyzer.

29. The tandem mass spectrometer according to claim 18, wherein the dissociating component is disposed after the mass selection gate within the drift region of the curved-field reflectron mass analyzer.

30. The tandem mass spectrometer according to claim 22, wherein the dissociating component is disposed after the mass selection gate within the drift region of the curved-field reflectron mass analyzer.

* * * * *